United States Patent [19]

Messenger et al.

[11] 4,243,549

[45] Jan. 6, 1981

[54] CONCENTRATED AQUEOUS SURFACTANT COMPOSITIONS

[75] Inventors: Edward T. Messenger, Workington; Douglas E. Mather; Brinley M. Phillips, both of Whitehaven, all of England

[73] Assignee: Albright & Wilson Ltd., Warley, England

[21] Appl. No.: 927,832

[22] Filed: Jul. 25, 1978

[30] Foreign Application Priority Data

Jul. 26, 1977 [GB] United Kingdom ..... 31350/77
May 26, 1978 [GB] United Kingdom ..... 31350/78

[51] Int. Cl.[3] ..... B01F 17/16

[52] U.S. Cl. ..... 252/355; 252/153; 252/354; 252/357; 252/542; 252/546; 252/DIG. 13

[58] Field of Search ..... 252/354–357, 252/542, 546, DIG. 13, 153

[56] References Cited

U.S. PATENT DOCUMENTS

| | | | |
|---|---|---|---|
| 3,912,662 | 10/1975 | Martinsson et al. | 252/153 X |
| 3,954,845 | 5/1976 | Martinsson et al. | 252/546 X |
| 4,061,602 | 12/1977 | Oberstar et al. | 252/153 X |

*Primary Examiner*—Leland A. Sebastian
*Attorney, Agent, or Firm*—Frishauf, Holtz, Goodman & Woodward

[57] ABSTRACT

Mixtures of amphoteric and anionic surfactants are obtained as concentrated aqueous systems in the G phase.

21 Claims, No Drawings

CONCENTRATED AQUEOUS SURFACTANT COMPOSITIONS

The present invention relates to novel concentrated aqueous surfactant compositions, which comprise mixtures of different surfactants for use in aqueous systems.

Mixtures of surfactants are prepared and sold for a wide variety of industrial and domestic applications. They are often required in a fluid form, and it is desirable that they should contain as high a proportion of active material as possible, in order to reduce the costs of storage and transport.

Where the mixture has a melting point below, or only slightly above ambient temperature it is sometimes possible to supply the composition in the form of an anhydrous mixture, or a mixture containing up to about 5% of water, respectively. In the latter case the trace of water appears to act as a melting point depressor. Some surfactant compositions, which are mainly of use in non-aqueous systems, form fluid mixtures containing small percentages of water. Such compositions are only soluble in predominantly aqueous systems at a concentration of up to about 2 to 5%.

However, in the case of surfactant mixtures which are suitable for use in aqueous systems at active concentrations between 5 and 30% by weight and which are solid at temperatures above about 25° C. it has often been impossible to obtain a fluid composition at concentrations above about 30 to 50% by weight of active ingredient, depending on the nature of the mixture. Small amounts of water up to about 10% do not depress the melting point sufficiently, while large amounts, sufficient to cause a phase change result in the formation of a rigid gel, rather than a fluid solution. It has generally been found that as the total concentration of active ingredient in a dilute solution approaches a critical level, which is usually about 30% by weight but may in the case of some mixtures be higher, e.g. up to about 55% by weight, the viscosity of the solution begins to rise, causing difficulty in preparing and handling the solution. At the critical level the solution sets into an immobile gel or phase separation occurs.

It is sometimes possible to increase the concentration of active ingredient by addition of viscosity modifiers or cosolvents, such as alcohols, which act as thinners, both lowering the viscosity of the solution and inhibiting the formation of gels, so that higher concentrations may be attained. Such cosolvents are normally only effective in producing substantial increases in the attainable concentration when they are present in such large amounts that they constitute a fire hazard, adversely affect the properties of the product for many of its desired end uses and/or increase the cost of the product.

It has been reported (see for example, "Advances in Colloid Interface Science" 1 (1976) 79–110 pp. 82–83) that some surfactant compounds are capable of forming highly viscous, non-pumpable liquid crystal phases. Some of these compounds form a phase of relatively low viscosity compared with the other liquid crystal phases, which is usually referred to as the "G" or "lamellar phase" and which forms only within a specific concentration range. However, in most instances, including the case of virtually all those compounds which are of industrial interest, where the existence of a "G" phase has been reported, it can only be formed at elevated temperatures. Thus, for example, sodium lauryl sulphate has been reported to form a "G" phase, at about 74° C., which is pourable. However, due to the elevated temperature required, this phenomenon has hitherto been regarded as having purely academic interest. It has hitherto never been possible to apply it in industry. Moreover, it has never been reported that mixtures of different kinds of surfactant are capable of forming a "G" phase.

Recently, we have discovered that certain surfactants of commercial value including some ammonium alkyl sulphates and some olefin sulphonates form "G" phase at ambient temperature. As a consequence of this discovery we are now able to prepare these surfactants in a fluid form at very much higher concentrations than could previously have been achieved. (See for example our copending British Patent Application No. 2038/74).

We have now discovered that certain mixtures of surfactants form a fluid lamellar (G) phase within a narrow range of concentrations lying above the concentration at which the immobile phase forms. This range often lies above 60% concentration and may be as high as 80%.

The mixtures tend to form fluid "G" phases at relatively low temperatures compared with the typical minimum temperatures at which aqueous solutions of most individual surfactants which are capable of forming "G" phases can exist in such a phase. Usually the mixtures can be obtained as a fluid "G" phase at ambient temperatures or by slight warming.

By preparing solutions of such mixtures at the particular concentration corresponding to the formation of the "G" phase we have been able to obtain pumpable mixtures of surfactants at concentrations of the total active compounds which are in some cases more than double the maximum which has hitherto been attainable. This gives rise to substantial savings in the cost of transporting and storing the products. It has also been discovered that the more highly active compositions of our invention have bacteriostatic properties.

The compositions are, generally, unexpectedly easy to dilute back to conventional dilutions, and, in many instances show little or no tendency to form an intermediate gel phase on addition of sufficient water to effect such dilution.

The invention provides an aqueous surfactant composition comprising water and an active mixture capable of dilution to concentrations in the range 5 to 30% by weight, active, and consisting of at least 10%, by weight of said active mixture, of at least one amphoteric or zwitterionic surfactant, and at least 10%, by weight of said active mixture, of at least one anionic surfactant, together, optionally, with one or more nonionic surfactant, said composition being, at least predominantly, in the "G" phase.

The "G" phase is a pumpable phase which is formed over a narrow range of concentrations which range usually lies between 40% and 80% by weight of active ingredient and is characterised by a lamellar structure in which the surfactant molecules are associated to form plates of indefinite size separated by planes of water molecules.

Typically when a surfactant mixture having a composition corresponding to the active ingredients according to the invention is prepared in aqueous solutions of increasing concentration, the molecules are first found to associate in spherical clusters (micelles), which with increasing concentrations become rod-like. At higher concentrations the micelles become more crowded causing a rise in the viscosity of the solution and, in the great majority of cases, eventually lengthen to form a regular hexagonal array of cylindrical surfactant micelles in an aqueous medium (the rigid "$M_1$" liquid crystal phase). If the concentration of a surfactant in the "$M_1$" phase is progressively increased a phase change occurs to give either a hydrated solid phase, or, in the case of surfactant mixtures of this invention, to convert the $M_1$ phase progressively to a fluid "G" phase until a viscosity minimum is reached. Further increase in the concentration of the "G" phase causes the viscosity to rise until a further phase change occurs. This may lead to the formation of either a hydrated solid or a second immobile liquid crystal phase (the $M_2$ phase) which resembles the $M_1$ phase in structure, but inverted—i.e. with water as the internal phase and the surfactant as the continuous phase.

The foregoing description is somewhat simplified. The term "hydrated solid phase" has been used broadly to include those systems which comprise suspensions of solid of immobile gel phases in one or more viscous or gel phase to provide a more or less rigid material usually having a granular appearance under a polarising microscope.

No one surfactant has been found which will form all of the various liquid crystal phases, however, surprisingly, all the mixtures of the classes of surfactant specified herein we have so far examined form a fluid "G" phase, even in cases where the individual components do not form "G" phases or form then only with difficulty, e.g. at high temperatures.

In general we have found, to a good approximation, that the proportion of active mixture required to form a "G" phase can be determined from the formula:

$$\frac{C_1}{g_1} + \frac{C_2}{g_2} + \ldots \frac{C_n}{g_n} = 1,$$

where $C_1 \ldots C_n$ are the concentrations of the individual active components and $g_1 \ldots g_n$ are the concentrations at which each component forms a "G" phase of minimum viscosity. This formula enables the concentration of the mixture corresponding to the minimum viscosity "G" phase to be estimated in a majority of cases. Where g is not known, or a component does not form a "G" phase, or the above formula is not applicable, then any "G" phase can be located very rapidly and easily, using standard laboratory equipment by making a test composition having an active concentration of say 75% (or, where appropriate, whatever concentration has been estimated on the basis of the foregoing formula) and placing a sample on a slide on the block of a heated stage microscope. Examination between crossed polarisers will reveal in which phase the sample is present. The various phases each have a characteristic appearance while is easily identified by comparison for example with the photographs of typical liquid crystal phases in the classic paper by Rosevear, JAOCS Vol. 31 P 628 (1954) or in J. Colloid and Interfacial Science, Vol. 30 No. 4 P 500.

If the mixture is in an $M_1$ phase, water may be allowed to evaporate from the edges of the sample under the cover disk and any phase changes observed. If an $M_2$ phase or hydrated solid is present water may be added around the edge of the cover disks and allowed to diffuse into the composition. If no "G" phase is located in this way samples may be heated progressively on the block and the operation repeated.

Usually the composition is pumpable at concentrations within a range of ±10%, preferably ±5% e.g. ±2.5% of the minimum viscosity concentration. This range tends to be broader at more elevated temperatures. Compositions may be obtained, at the limits of the range in which one or more solid or gel phase is suspended in a continuous "G" phase. Such compositions are often useful on account of their appearance and constitute a particular aspect of the invention.

Typically the compositions of the invention contain two, three or four different kinds of surfactant each in a concentration of more than 10% by weight of the composition.

The compositions of our invention may contain minor amounts of non-surfactant organic solvents, such as glycols or fatty alcohols, and of non-cooloidal electrolytes such as sodium chloride, or sulphate. Such inclusions are often present as impurities in the surfactants. However, we prefer not to add appreciable amounts of solvents to the compositions of our invention. We prefer where possible to maintain the proportion of non-surfactant organic solvent below 5% by weight of the active mixture and preferably below 5% by weight of the total composition. Most preferably the proportion is less than 2% by weight of the total composition e.g. less than 1%. The presence of inorganic salts or similar non-colloidal electrolytes does not generally have the same substantial disadvantages as the presence of organic solvents, but it is nevertheless generally undesirable because it tends to raise the viscosity of the fluid "G" phase. We therefore prefer, generally, that the proportion of non-colloidal electrolyte be maintained within the same limits as those stated in relation to organic solvents. However there are certain circumstances in which the presence of some electrolyte may be useful, e.g. when the melting point of the "G" phase is slightly above ambient, and an increase in the electrolyte content may depress the melting point sufficiently to obtain a pumpable "G" phase without heating. In such circumstances it may sometimes be desirable deliberately to add up to about 6% by weight of electrolyte, usually sodium chloride, or sodium sulphate.

The composition of our invention may optionally contain minor amounts, e.g. up to 5% by weight of the active mixture, of surface active material other than those specified hereinbefore.

The active mixtures in the compositions of our invention comprise at least one amphoteric surfactant. The amphoteric surfactant may for example be a betaine, e.g. a betaine of the formula:

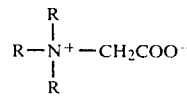

wherein each R is an alkyl, cycloalkyl, alkenyl or alkaryl group and preferably at least one and most preferably not more than one R has an average of from 8 to 20 e.g. 10 to 18 aliphatic carbon atoms and each other R has an average of from 1 to 4 carbon atoms. Particularly preferred are the quaternary imidazoline betaines of the formula:

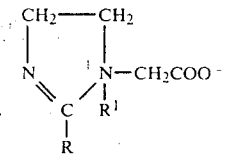

wherein R and $R^1$ are alkyl, alkenyl, cycloalkyl, alkaryl or alkanol groups having an average of from 1 to 20 aliphatic carbon atoms and R preferably has an average of from 8 to 20 e.g. 10 to 18 aliphatic carbon atoms and $R^1$ preferably has 1 to 4 carbon atoms. Other amphoteric surfactants for use according to our invention include alkyl amine ether sulphates, sulphobetaines and other quaternary amine or quaternised imidazoline sulphonic acids and their salts, and other quaternary amine or quaternised imidazoline carboxylic acids and their salts and Zwitterionic surfactants e.g. N-alkyl taurines, carboxylated amido amines such as $RCOHN(CH_2)_2N(CH_2CH_2CH)CH_2CO_2$, and amino acids, having, in each case hydrocarbon groups capable of conferring surfactant properties (e.g. alkyl, cycloaklyl, alkenyl or alkaryl groups having from 8 to 20 aliphatic carbon atoms). Typical examples include 2 tallow alkyl 1-tallow amido alkyl 1 carboxymethyl imidazoline and 2 coconut alkyl N-carboxymethyl 2 (hydroxyalkyl) imidazoline. Preferred amphoteric surfactants include amido amine betaines having a total of from 12 to 28 carbon atoms, and alkyl dimethylamine betaines wherein the alkyl group has from 8 to 22 carbon atoms. Generally speaking any water soluble amphoteric or Zwitterionic surfactant compound which comprises a hydrophobic portion including a $C_{8-20}$ alkyl or alkenyl group and a hydrophilic portion containing an amine or quaternary ammonium group and a carboxylate, sulphate or sulphonic acid group may be used in our invention.

The anionic component may typically be an alkyl sulphate, alkyl ether sulphate, e.g., those wherein the alkyl group has from 8 to 22 carbon atoms, alkyl benzene sulphonate, olefin sulphonate, parafin sulphonate, sulphosuccinate, sulphosuccinamate, a tauride or sarcosinate, a soap, an alkyl phenyl sulphate, alkyl phenyl ether sulphate or alkyl phenyl ether sulphonate, a fatty acid sulphonate or fatty ester sulphonate or an alkyl phosphate or alkyl ether phosphate, wherein, in each case, there is at least one alkyl or alkenyl group having a total of from 8 to 20, preferably 10 to 18 carbon atoms. In the foregoing list, the term "ether" implies a glyceryl group and/or a polyoxyalkylene group formed of from 1 to 30, preferably 1 to 10 oxyethylene and/or oxypropylene groups.

The amphoteric and anionic surfactants preferably each constitute at least 10% by weight of the active mixture more preferably at least 20% most preferably at least 30% e.g. at least 40%. Preferably the amphoteric and anionic surfactants are present in substantially equimolar amounts, e.g. each constituting 50% of the weight of the active mixture. The cation or cations of the anionic surfactant may be or comprise an alkali metal such as sodium, potassium or lithium, ammonium or a substituted ammonium such as a primary, secondary, tertiary or quanternary alkyl ammonium or alkylolammonium ion or, where solubility permits, an alkaline earth metal such as calcium.

The nonionic surfactants optionally present in the compositions of our invention may comprise, for example, ethoxylated fatty alcohols, ethoxylated fatty acids, ethoxylated alkyl phenols, ethoxylated glyceryl or sorbitan fatty esters. Other nonionic surfactants include alkylolamides ethoxylated alkylolamide, and amine oxides.

In each case the nonionic surfactant has an alkyl group having from 8 to 20, preferably 10 to 18 carbon atoms. The nonionic surfactant is preferably present in a proportion not exceeding 50% by weight of the active mixture, more preferably less than 30%, most preferably less than 20% e.g. less than 10%.

Typically the pH of the composition is between 5 and 10. Depending upon the chemical nature or the amphoteric of zwitterionic species, fluid "G" phases may be obtained within particular pH ranges, usually between 7 and 9 e.g. above about 8. If the pH is sufficiently low to protonate the acid group of the amphoteric surfactant, there is sometimes a tendency for the "G" phase to convert into a different phase, e.g. an opaque emulsion. Such emulsions are stable and pourable and contain the active mixture in concentrations corresponding to the "G" phase. They are, therefore, useful products and constitute a further aspect of the present invention.

The invention is illustrated by the following examples:

EXAMPLE I

One mole of 1-(hydroxyethyl)-2-cocoyl imidazoline was warmed at 55° C. for twelve hours with 2.1 moles chloracetic acid and 4.1 moles sodium hydroxide in the presence of sufficient water to provide a solution of 23% of the imidazoline starting material by weight. The pH was adjusted to 8.5 with 35% aqueous hydrochloric acid. (The pH being measured on a dilute solution comprising 10 parts of the solution and 90 parts water).

A formulation was prepared comprising 58.4% of the quaternised imidazoline solution prepared above, 37.9% of a 29% aqueous solution of sodium lauryl sulphate and 3.7% of 90% sodium lauryl sulphate, all percentages being by weight. The product was a free flowing translucent composition which proved to be in the "G" phase on microscopic examination.

EXAMPLE II

One mole of 1-(hydroxyethyl)-2-lauryl imidazoline was reacted with 2.5 moles of chloracetic acid and 4.8 moles of sodium hydroxide in the presence of sufficient water to provide a 20% solution of the imidazoline starting material by weight at 55° C. for twelve hours.

A formulation was prepared comprising 67% of the quaternised imidazoline solution, 33% of a 70% aqueous solution of sodium lauryl three moles ethylene oxy sulphate. The product was a free-flowing translucent composition which proved to be in the "G" phase under microscopic examination.

EXAMPLE III 29.9 gm of a 70.6% solution of a $C_{12/14}$ sodium alkyl 3 mole ethoxylated sulphate, and 70.1 gm of a 30% solution of a $C_{8-18}$ amido amine betaine of the formula

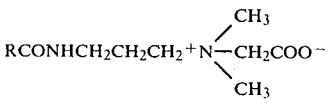

were mixed together.

The blend contained equal parts by weight of anionic and amphoteric surfactant, and had a total surfactant concentration of 42.1%. The product was a viscous gel, identified as $M_1$ phase.

The sample was heated on a steam bath in a current of air, to evaporate some of the water, until the total surfactant concentration was 73.8%. The concentrated blend was a free flowing translucent composition which proved to be in the "G" phase on microscopic examination.

The composition of this blend was as follows:

| | |
|---|---|
| Sodium alkyl 3 mole ethoxylates sulphate | 37% |
| Amido Amine betaine | 37% |
| Sodium chloride | 9% |
| Other impurities | 2-3% |
| Water | Balance |

EXAMPLE IV 46 gm of a 70.6% solution of a $C_{12/14}$ sodium alkyl mole ethoxylated sulphate, and 54 gm of a 30% solution of a $C_{8-18}$ amido amine betaine of the formula

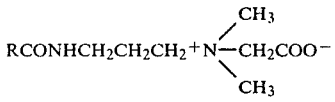

were mixed together. The blend contained 2 parts by weight of anionic surfactant for every 1 part by weight of amphoteric surfactant, and had a total surfactant concentration of 48.7%. The product was a viscous gel, identified as $M_1$ phase.

The sample was heated on a steam bath in a current of air, to evaporate some of the water, until the total surfactant concentration was 64.6%. The concentrated blend was a free flowing translucent composition which proved to be in the "G" phase on microscopic examination.

The composition of this blend was as follows:

| | |
|---|---|
| Sodium alkyl 3 mole ethoxylated sulphate | 43% |
| Amido Amine Betaine | 21.5% |
| Sodium chloride | 5.5% |
| Other Impurities | 2-3% |
| Water | Balance |

EXAMPLE V 29.9 gm of a 70.6% solution of a $C_{12/14}$ sodium alkyl 3 mole ethoxylated sulphate, and 70.1 gm of a 30% solution of $C_{12/14}$ alkyl dimethylamine betaine were mixed together. The blend contained equal parts by weight of anionic and amphoteric surfactant, and had a total surfactant concentration of 42.1%. The product was a viscous gel identified as $M_1$ phase.

The sample was heated on a steam bath in a current of air, to evaporate some of the water, until the total surfactant concentration was 59.4%. The concentrated blend was a free flowing translucent composition which proved to be in the "G" phase on microscopic examination.

The composition of this blend was as follows:

| | |
|---|---|
| Sodium alkyl 3 mole ethoxylated sulphate | 30% |
| Alkyl dimethylamine betaine | 30% |

-continued

| | |
|---|---|
| Sodium chloride | 7.5% |
| Other impurities | 2-3% |
| Water | Balance |

EXAMPLE VI 28.9 gm of a 71.1% solution of the monethanolamine salt of a $C_{12/14}$ alkyl sulphate, and 70.2 gm of a 30% solution of a $C_{12/14}$ alkyl dimethylamine betaine, which had been treated by electrodialysis to remove sodium chloride, were mixed together.

The blend was a free flowing translucent composition which proved to be in the "G" phase on microscopic examination.

The composition of the blend was as follows:

| | |
|---|---|
| Monoethanolamine salt of alkyl sulphate | 21% |
| Alkyl dimethylamine betaine | 21% |
| Other impurities | 2-3% |
| Water | Balance |

EXAMPLE VII 39 gm of a 46.9% solution of dioctylsulphosuccinate and 61 gm of a 30% solution of $C_{12/14}$ alkyl dimethylamine betaine, which had been treated by electrodialysis to remove sodium chloride, were mixed together. The blend contained equal parts by weight of anionic and amphoteric surfactant, and had a total surfactant concentration of 36.6%. The sample was a viscous gel, identified as $M_1$ phase.

The sample was heated on a steam bath in a current of air to evaporate some of the water, until the total surfactant concentration was 62.7%. The concentrated blend was a free flowing translucent composition which proved to be in the "G" phase on microscopic examination.

The composition of this blend was as follows:

| | |
|---|---|
| Alkyl dimethylamine betaine | 31.5% |
| Dioctyl sulphosuccinate (Na salt) | 31.5% |
| Dioctyl maleate | 5% |
| Other impurities | 1% |
| Water | Balance |

EXAMPLE VIII 29.9 gm of a 70.6% solution of a $C_{12/14}$ sodium alkyl mole ethoxylated sulphate, and 70.1 gm of a 30% solution of a $C_{8-18}$ amido amine of the formula.

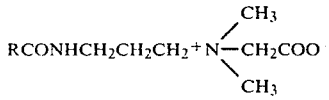

contain 2.5% glycerol, were mixed together. The blend contained equal parts by weight of anionic and amphoteric surfactant, and had a total surfactant concentration of 42.1%. The material was a viscous gel identified as $M_1$ phase.

The sample was heated on a steam bath in a current of air, to evaporate some of the water, until the total surfactant concentration was 67%. The concentrated blend was a free flowing translucent composition which proved to be in the "G" phase on microscopic examination.

The composition of this blend was as follows:

| | |
|---|---|
| Sodium alkyl 3 mole ethoxylated sulphate | 33.5% |
| Amido Amine Betaine | 33.5% |
| Sodium chloride | 8.5% |
| Glycerol | 3.0% |
| Other impurities | 2-3% |
| Water | Balance |

EXAMPLE IX 39 gm of a 46.9% solution of dioctyl sulphosuccinate and 61 gm of a 30% solution of a $C_{8-18}$ amido amine of the formula

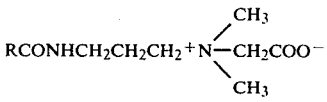

were mixed together. The blend contained equal parts by weight of anionic and amphoteric surfactant, and had a total surfactant concentration of 36.6%. The material was a viscous gel identifies as $M_1$ phase.

The sample was heated on a steam bath in a current of air to evaporate some of the water, until the total surfactant concentration was 61%. The concentrated blend was a free flowing translucent liquid, which proved to be in the "G" phase on microscopic examination.

The composition of this blend was as follows:

| | |
|---|---|
| Amido amine betaine | 30.5% |
| Di Octyl sulphosuccinate (Na salt) | 30.5% |
| Di Octyl Maleate | 5% |
| Sodium chloride | 7.5% |
| Other impurities | 1% |
| Water | Balance |

We claim:

1. A pourable aqueous surfactant composition consisting essentially of water and an active mixture dilutable to a fluid active concentration between 5 and 30% by weight, said mixture consisting essentially of at least 10% based on the weight of said active mixture of at least one amphoteric surfactant, and at least 10% by weight of said active mixture of at least one anionic surfactant, the total weight of surfactants forming said active mixture being sufficient so that said composition is, at least predominantly, in the G phase.

2. A composition as claimed in claim 1 additionally containing at least one nonionic surfactant.

3. A composition as claimed in claim 1 wherein the sum of the ratios of the concentration of each active component in the composition, to the concentration at which that component is capable of forming a G phase in water, is unity.

4. A composition as claimed in claim 1 wherein the graph of viscosity against the concentration of active mixture exhibits a minimum value corresponding to the formation of the G phase and wherein the proportion of active mixture present in the composition lies with ±10% of the concentration corresponding to the minimum value.

5. A composition as claimed in claim 4 wherein the concentration of the active mixture lies within ±5% of the concentration corresponding to the minimum value.

6. A composition as claimed in claim 5 wherein the concentration of active mixture lies within ±2.5% of the concentration corresponding to the minimum value.

7. A composition as claimed in claim 1 containing less than 5% by weight of non-surfactant organic material based on the weight of the active mixture.

8. A composition as claimed in claim 7 containing less than 2% of non-surfactant organic material based on the weight of the total composition.

9. A composition as claimed in claim 8 substantially free from non-surfactant organic solvent.

10. A composition as claimed in claim 1 containing less than 5% of non-colloidal electrolyte based on the weight of the active mixture.

11. A composition as claimed in claim 10 containing less than 2% by weight of non-colloidal electrolyte based on the weight of the total composition.

12. A composition as claimed in claim 1 wherein said amphoteric surfactant is an alkyl dimethylamine betaine wherein the alkyl group has from 8 to 22 carbon atoms.

13. A composition as claimed in claim 1 wherein the amphoteric surfactant is an amido amine betaine having a total of from 12 to 28 carbon atoms.

14. A composition as claimed in claim 1 wherein the amphoteric surfactant is an imidazoline betaine.

15. A composition as claimed in claim 1 wherein the anionic surfactant is an alkyl sulphate having from 8 to 22 carbon atoms.

16. A composition as claimed in claim 1 wherein the anionic surfactant is an alkyl ether sulphate wherein the alkyl group has from 8 to 22 carbon atoms.

17. A composition as claimed in claim 1 wherein the anionic surfactant is an alkyl sulphosuccinate.

18. A composition as claimed in claim 1 wherein said amphoteric surfactant is an alkyl dimethylamine betaine wherein the alkyl group has from 8 to 20 carbon atoms.

19. A composition as claimed in claim 1 wherein the amphoteric surfactant is an amido amine betaine having a total of from 8 to 20 carbon atoms.

20. A composition as claimed in claim 1 wherein the anionic surfactant is an alkyl sulphate having from 8 to 20 carbon atoms.

21. A composition as claimed in claim 1 wherein the anionic sufactant is an alkyl ether sulphate wherein the alkyl group has from 8 to 20 carbon atoms.

* * * * *